United States Patent [19]

Sampayan et al.

[11] Patent Number: 4,760,262

[45] Date of Patent: Jul. 26, 1988

[54] ION SOURCE

[75] Inventors: Stephen E. Sampayan, Austin; Monroe L. King, Port Lavaca; Robert A. Moore, Austin, all of Tex.

[73] Assignee: Eaton Corporation, Cleveland, Ohio

[21] Appl. No.: 49,759

[22] Filed: May 12, 1987

[51] Int. Cl.[4] ..... H01J 27/00

[52] U.S. Cl. ..... 250/423 R; 315/111.81; 250/427

[58] Field of Search ..... 250/423 F, 423 R, 426, 250/427; 313/341, 359.1, 595, 631, 632; 315/111.81

[56] References Cited

U.S. PATENT DOCUMENTS

| | | | |
|---|---|---|---|
| 4,139,772 | 2/1979 | Williams | 250/423 R |
| 4,288,716 | 9/1981 | Hinkle et al. | 315/111.81 X |
| 4,608,513 | 8/1986 | Thompson | 313/359.1 |
| 4,687,938 | 8/1987 | Tamura et al. | 250/423 R X |

FOREIGN PATENT DOCUMENTS

| | | | |
|---|---|---|---|
| 0160941 | 9/1984 | Japan | 313/359.1 |
| 0916703 | 1/1963 | United Kingdom . | |

OTHER PUBLICATIONS

Alton, "Aspects of the Physics, Chemistry & Tech. of High Intensity Heavy Ion Sources", *Nuclear Inst. & Methods*, pp. 15–42, 1981.

Freeman, "A New Ion Source for E-M Isotope Separators", *Nuclear Inst. & Methods, pp. 306–316 (1963).*

La Postolle and Septier, *Linear Accellerators*, North Holland Pub. Co., pp. 838–874, 1970.

Yabe, "Ion Source with Plasma Cathode", Rev. *Scientic Instruments*, pp. 1–5, 1987.

*Primary Examiner*—Eugene R. Laroche
*Assistant Examiner*—Steven J. Mottola
*Attorney, Agent, or Firm*—F. M. Sajovec

[57] ABSTRACT

An ion source (10) of the side-extraction hot cathode type in which the inherent drift of electrons toward the positive side of the cathode is minimized by the addition of auxiliary electrodes (31, 32) which surround the cathode (14) at the ends of the anode (12). The electrodes are electrically isolated from the cathode and anode, and various means are provided to apply a potentials to the electrodes, including interconnecting the electrodes, cross-connecting the electrodes to opposite ends of the cathode, and biasing the electrodes at fixed potentials with respect to the cathode, anode or ground.

24 Claims, 3 Drawing Sheets

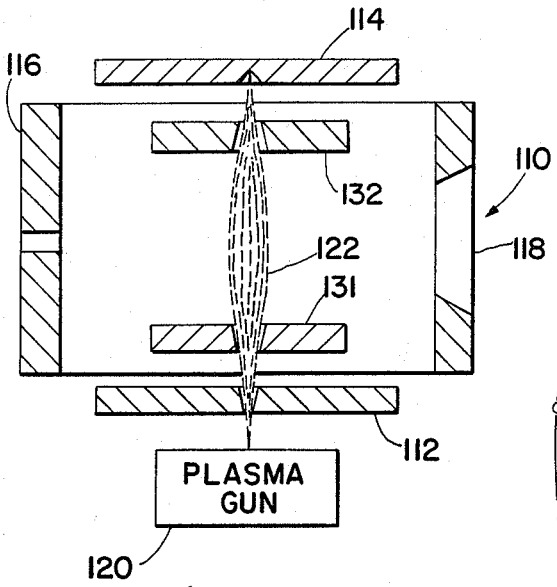
Fig. 7
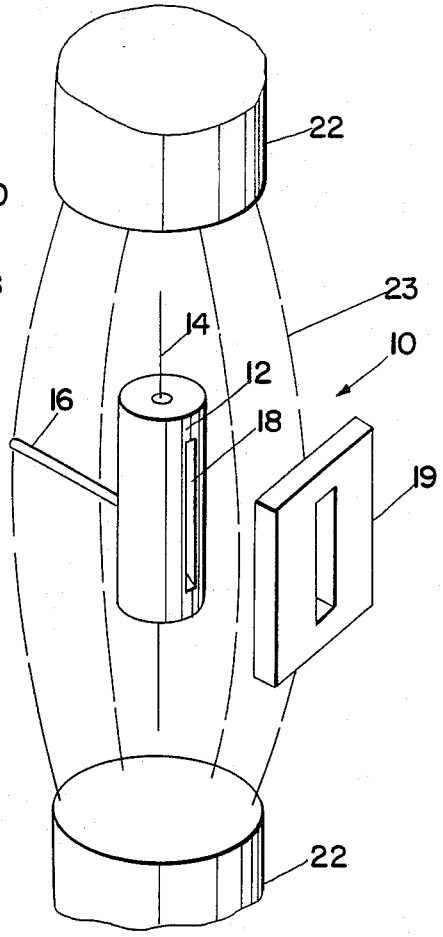
Fig. 1
Fig. 2
PRIOR ART
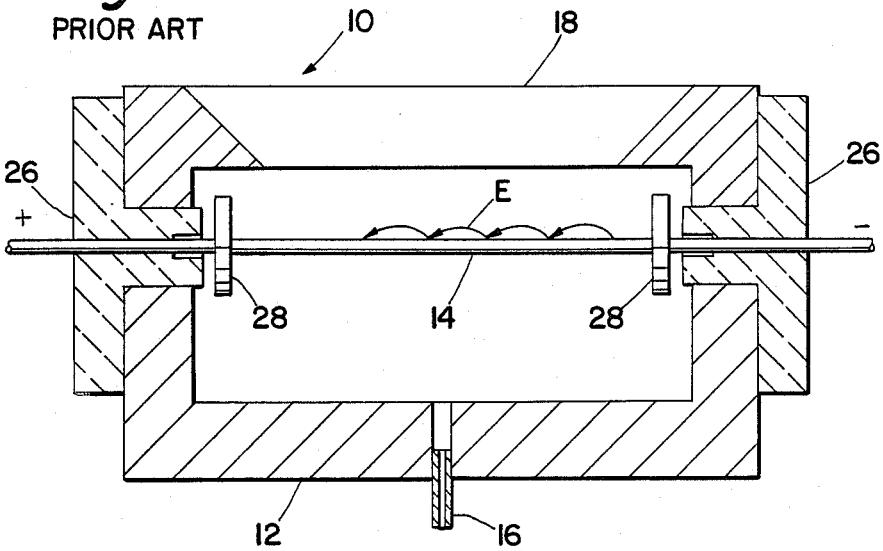

ION SOURCE

The present invention relates generally to ion sources, and particularly to an ion source of the type in which a compound of the material of a desired ion is dissociated in a plasma discharge process for use in an ion implantation apparatus. The ions are extracted from the source by means of electric extraction fields to provide a beam of charged particles. The beam includes the desired ions which are subsequently separated from the beam by mass-charge separation techniques.

A problem common to such ion sources is in fully controlling the dissociation process, the result being that the proportion of the desired ion in the output current is generally significantly less than what would appear to be possible. This phenomenon is particularly prevalent if singly charged boron ions are desired from a source gas of a compound of boron, since some compounds of boron are particularly difficult to break down. Accordingly, the total quantity of boron in the desired ionic form has, heretofore, been significantly less than the total quantity of boron present in the gas.

Plasma dissociation ion sources rely on electron impact of uncharged gaseous material to produce a plasma. A commonly used electron impact ion source is a type of side-extraction hot cathode source which comprises a single rode type filament cathode placed within a cylindrically shaped anode, with the axis of the filament cathode and cylindrical anode parallel to each other. A fixed, externally applied magnetic field parallel to these axes is also applied to help constrain the motion of the ionizing electrons. Gaseous material which is to be ionized is admitted through a penetration in the anode wall.

To ionize the gaseous material, a potential difference is established between the cathode filament and the cylindrical anode. This electrical field is used to impart radial energy to the electrons thermoionically emitted from the cathode filament. If the electrons can gain enough energy for ionizing collisions to result; a plasma will be established. Positive ions created within the plasma can then be extracted through a narrow longitudinal slit in the anode wall.

Extraction of the positive ions is done by placing a negatively biased electrode external to the plasma and concident with the longitudinal slit plane. This electrode establishes an electric field with the anode which interacts with the plasma boundary and accelerates the positive ions from the plasma.

It is theorized that the efficiency of a given ion source is highly dependent upon the density and temperature of the ionizing electrons, and hence the plasma temperature. In addition, the ionizing electrons must be made to traverse relatively long path lengths within the plasma so that there is an increased probability of collision with a neutral gas particle. In the above described source this is accomplished by the combined effects of the magnetic field resulting from the current used to heat the filament and the externally applied magnetic field.

It can be theorized that for sufficient filament currents, charged particles will have different radial drift velocities at different radial distances from the filament cathode. Charged particles close to the filament will have a net drift velocity directed toward the positive side of the filament cathode and azimuthally with respect to the filament axis at increased radial distances. Thus, most electrons are constrained from reaching the anode by a direct radial drift mechanism and are forced to traverse long path lengths. There is, however, an inherent net drift of electrons toward the positive side of the filament. Those electrons which reach the axial end of the anode are collected by the anode and thus removed from the plasma, resulting in a yield of ions which is lower than expected.

As noted above, such low yield is particularly noticeable when singly charged boron ions ($B^+$) are desired. A common source material for boron is boron trifluoride ($BF_3$), which is a gaseous material at room temperature, elemental boron not being used because of its high vaporization temperature. Analysis of ion beams produced using this source material reveals the presence of the desired boron ions, but also such ions as $BF^+$ and $BF_2^+$ with the percentage of the singly charged boron ions being relatively low, typically less than 15%.

In certain prior art systems, this electron leakage is reduced by placing metallic electron reflectors at each end of the filament cathode. These metallic reflectors are used to perturb the cathode/anode electric field so as to redirect the electrons to the center of the discharge. Another prior art method is to increase the magnetic field at each end of the filament. The increased magnetic field acts to reflect electrons back to the discharge similar to the way in which the reflectors function.

While the prior art systems are generally successful, they do not produce the increased plasma temperature which is necessary to significantly increase the yield of boron ions when a gaseous boron compound is used as the source feed material. Further, in certain prior art systems it has been observed that with increased extractor electrode currents, the ion beam current in a direction parallel to the extraction slit becomes less symmetric.

In the present invention, the plasma temperature and the uniformity of the ion beam current density in a direction parallel to the slit is increased by placing electrodes which are electrically isolated from the filament at each end of the cylindrical anode. In accordance with a preferred embodiment of the invention, these auxiliary filament electrodes are shorted together to establish identical potentials at each end of the plasma. In accordance with another embodiment of the invention, the filament electrodes are cross-connected to the potential at the opposite side of the filament, and in accordance with a still further embodiment the filament electrodes are biased at fixed potentials with respect to the cathode, anode or ground.

As is well known in the art it is difficult to conclude with certainty the reasons why certain phenomena occur in the presence of plasmas; however, it is hypothesized that the auxiliary filament electrodes effectively inhibit the axial drift of electrons, which increases the uniformity of the discharge and results in the desired increased plasma temperature and uniformity of the ion beam current density in a direction parallel to the slit.

Other objectives and advantages of the invention will become apparent from the following description when considered in connection with the accompanying drawings, wherein;

FIG. 1 is a schematic, perspective view of a type of hot cathode ion source incorporating the invention;

FIG. 2 is a cross-sectional, schematic view of a portion of a prior art ion source;

FIG. 7 is a schematic representation of a still further embodiment of the invention.

Figure 3:
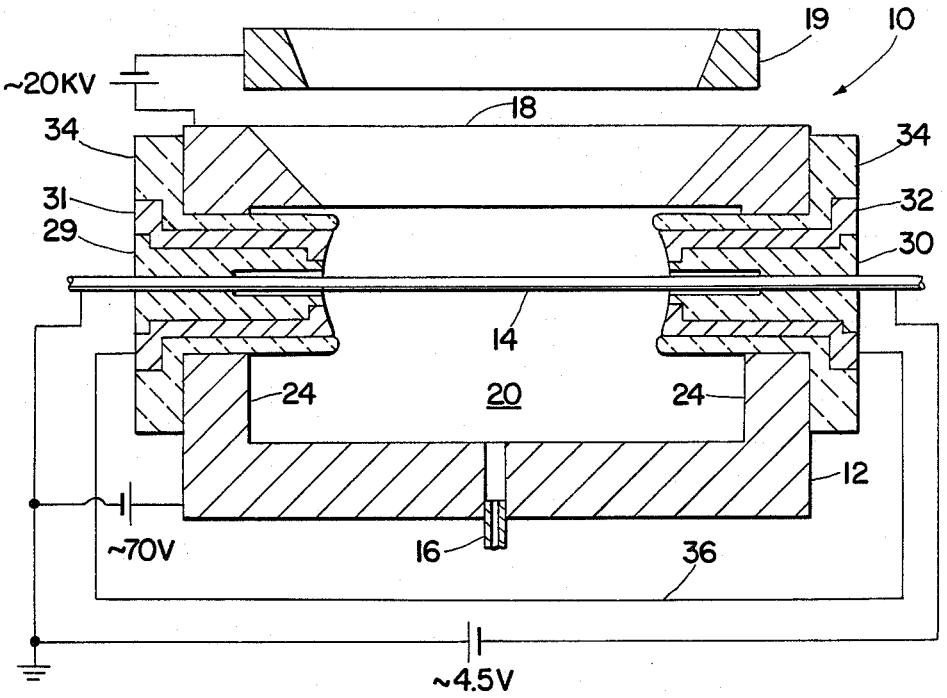
FIG. 3 is a cross-sectional schematic view of a portion of an ion source incorporating the present invention.

Referring to FIGS. 1 and 3 there is schematically illustrated a well-known type of ion source 10 which relies on the plasma dissociation of a gaseous source material. The source comprises a hollow cylindrical anode 12, of, for example, molybdenum or tantalum having disposed therein an axially extending heated cathode filament 14. The source is contained in an evacuated chamber (not shown), and a gaseous compound of the desired ionic material is caused to flow into the anode cylinder through an inlet tube 16. A direct current voltage differential is established between the anode and the cathode as shown in FIG. 3, the voltage being of sufficient amplitude to cause an electric discharge through the gas between the cathode and the anode. This discharge causes a dissociation of the gas into various neutral and charged particles. The neutral particles exit as part of the gas flow through an exit slit 18, and the charged particles, both positive and negative, fill the space 20 within the anode 12. Positively charged particles which drift close to the slit 18 are extracted from the anode by means of an extraction electrode 19 and accelerated in a known manner to provide a beam of charged particles.

In accordance with known implantation practice, the desired particles are separated from the beam using known mass-charge separation techniques.

To increase the number of charged particles, that is the density of the plasma within the anode 12, a magnet having pole pieces 22 can be used to provide an axial magnetic field 23 about and within the anode 12. Such axial field tends to increase the path length of the plasma electrons and thus the plasma density by inducing the electrons to circle about the cathode rather than proceeding relatively directly from the cathode toward the anode. As discussed above, because of the flow of current along the cathode 14 an additional magnetic field is present which causes the electrons to drift axially along the length of the anode toward an axial end 24 where the electrons tend to collect. In accordance with the present invention the drift, or collection of electrons at the end of the anode is minimized.

Referring to FIG. 2, there is illustrated a prior art hot cathode ion source 10 comprising an anode 12, a cathode filament 14, gas inlet tube 16, and extraction slit 18. In accordance with the prior art, the filament is mounted within insulators 26 received in apertures formed in the ends of the cylindrical anode 12. The electron drift as discussed above is illustrated by the arrows E. As illustrated in FIG. 2 the prior art source may include reflectors 28 attached directly to the filament adjacent the ends of the anode.

Referring to FIG. 3, there is illustrated a preferred embodiment of the present invention. In this embodiment, the filament 14 is mounted in first insulators 29 and 30, which are in turn mounted within cylindrical auxiliary electrodes 31 and 32. This assembly is then mounted within cylindrical insulators 34 received in apertures formed in the ends of the anode 12.

As shown in FIG. 3, the source 10 is powered in a well-known manner, for example, with a filament voltage of around 4.5 volts, an arc voltage of around 70 volts applied between the anode and the cathode and a voltage of around 20 kv applied between the anode and the extraction electrode 19. In accordance with the preferred embodiment the auxiliary electrodes 31 and 32 are connected together as by means of a line 36. When thus shortened, identical potentials are established at each end of the plasma within the volume 20, which tends to inhibit the axial drift of the electrons within the plasma. When electrons drift axially out of the central portion of the plasma, toward the electrodes 31 and 32, it is believed that some of these electrons strike the electrodes causing the electrodes to become electrically charged. The electrical charge biases the electrodes such that they perturb the electrical fields in the source in a manner that tends to repel drifting electrons back into the central portion of the plasma. Tests have shown that when the hot cathode source is operated in the FIG. 3 mode, a substantial increase, in the range of 20%-25%, in the amount of $B^+$ ion from boron trifluoride is observed.

Figure 4:
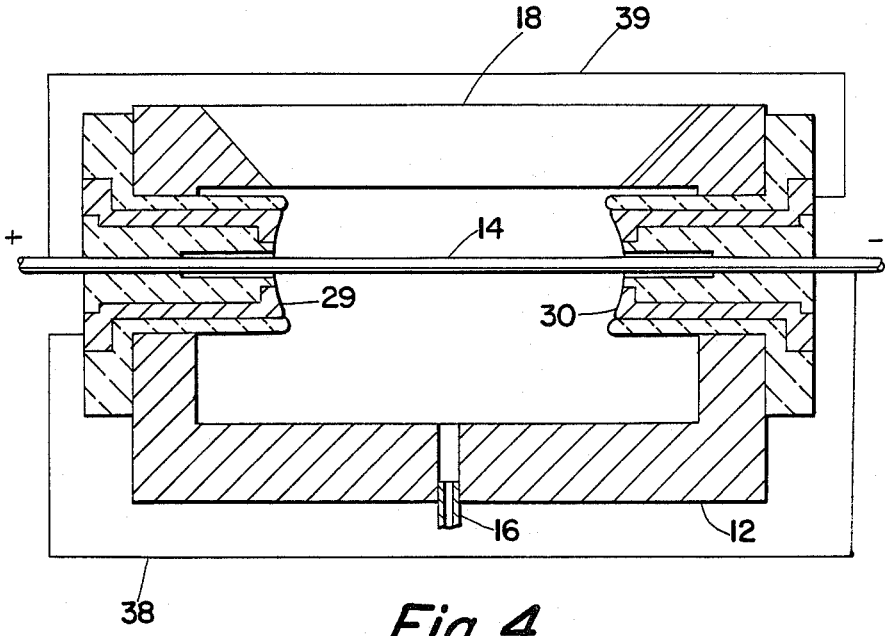
FIGS. 4, 5 and 6 are views similar to FIG. 3, but illustrating alternate embodiments of the invention.

An alternative embodiment of the invention is illustrated in FIG. 4, wherein the cathode structure and basic power connections are identical to that shown in FIG. 3; however, in this embodiment the auxiliary electrode 29 is electrically connected to the opposite end of the filament 14 by line 38, and the auxiliary electrode 30 is electrically connected to the opposite side of filament 14 by line 39. It is theorized that this configuration tends to neutralize the effect on the plasma of the voltage drop across the filament, which also inhibits the axial drift of electrons.

Figure 5:
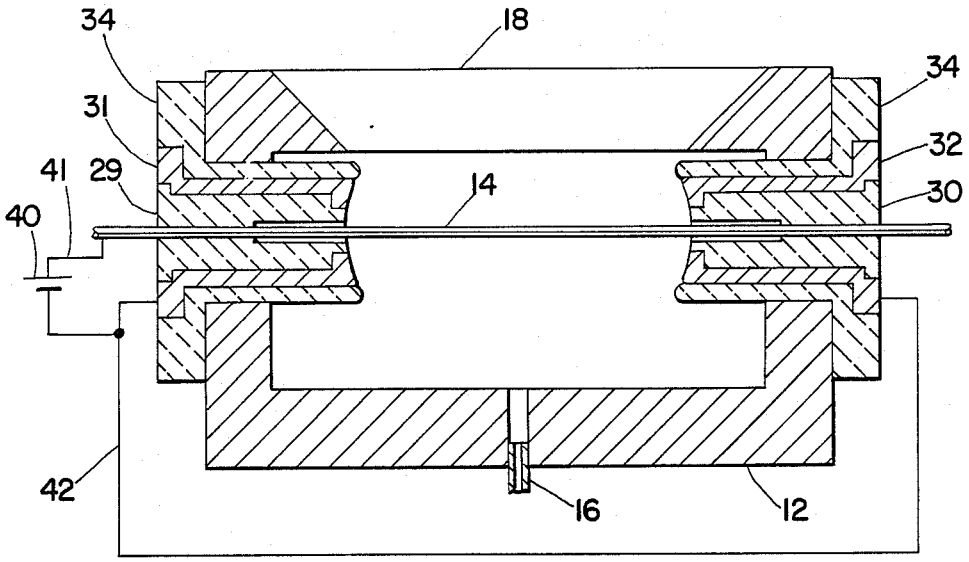

In the embodiment illustrated in FIG. 5, a voltage is applied between the filament and the auxiliary electrodes, by means of voltage source 40 and lines 41 and 42, which tends to force electrons toward the center of the discharge. In this embodiment there would be a greater-than-normal tendency for material to sputter off the electrodes 31 and 32 and/or the insulators 29, 30 and 34; however, if these components were fabricated of materials which are desired in the ion beam, such as berylluim, aluminum or zinc, this sputtering tendency could be used to advantage in selected processes.

Figure 6:
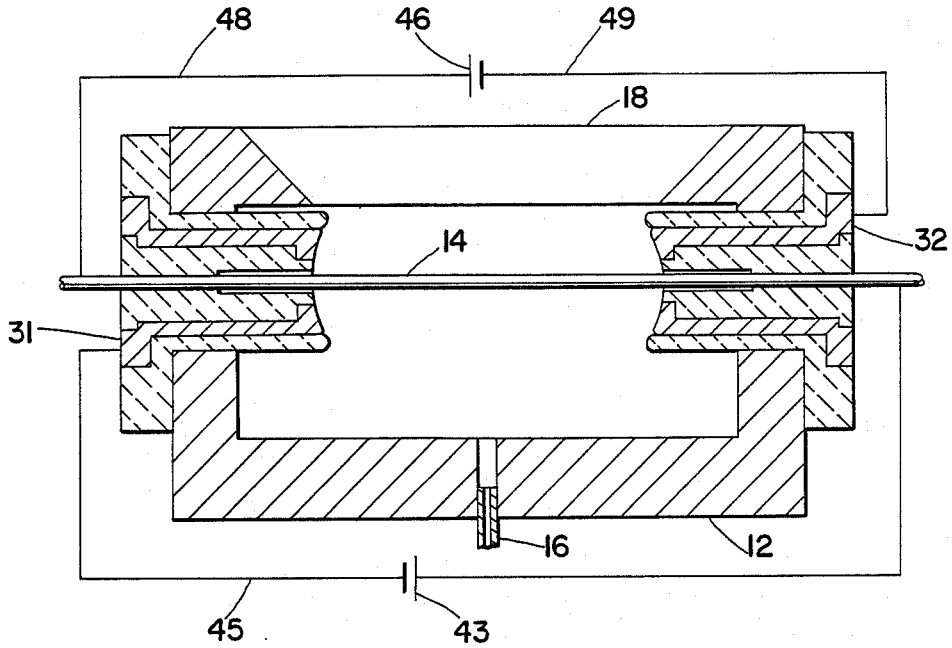

In the embodiment shown in FIG. 6, a voltage of around 25 volts is applied between one end of the filament 14 and auxiliary electrode 31 by means of a voltage source 43 and lines 44 and 45, and a voltage of equal value is applied between the opposite end of filament 14 and auxiliary electrode 32 by means of voltage source 46 and lines 48 and 49.

Although the present invention is illustrated in connection with a particular type of ion source the concepts are also applicable to other sources. For example, FIG. 7 illustrates a type of hot cathode source wherein the cathode filament is in the form of a plasma. This source, designated 110 comprises a first anode 112, a second anode 114, and a third, cylindrical anode 116 having an extraction slit 118 formed therein, and a plasma gun 120 which generates a plasma filament 122. Auxiliary electrodes 131 and 132, which correspond to the electrodes 31 and 32 in the embodiments of FIGS. 3-6 surround the plasma filament, but are not contacted by the plasma, and serve the same purposes when similarly powered or connected.

We claim:

1. In an ion source comprising a housing forming a chamber, means for supporting a cathode within the housing, means for establishing an electrostatic field between the cathode and the housing, means for applying a DC voltage across opposite ends of the cathode to induce a heating current therein, and means for supplying a source of ionizable gas into said chamber; the improvement comprising a first electrode in close proximity to said cathode adjacent one end thereof, means electrically isolating said first electrode from said cathode and from said housing, a second electrode in close proximity to said cathode adjacent the opposite end thereof, means electrically isolating said second electrode from said cathode and from said housing, and biasing means operable to apply potentials to said first and second electrodes.

2. Apparatus as claimed in claim 1, in which said biasing means comprises means maintaining said first and second electrodes at equal potentials.

3. Apparatus as claimed in claim 2, in which said biasing means includes means interconnecting said first and second electrodes.

4. Apparatus as claimed in claim 1, in which said biasing means comprises means biasing said first electrode at the potential of said cathode adjacent said second electrode, and means biasing said second electrode at the potential of said cathode adjacent said first electrode.

5. Apparatus as claimed in claim 4, in which said biasing means comprises means electrically connecting said first electrode to said cathode at a point adjacent said second electrode, and means electrically connecting said second electrode to said cathode at a point adjacent said first electrode.

6. Apparatus as claimed in claim 1, in which said biasing means comprises means applying a predetermined potential between said cathode and both said first and second electrodes.

7. Apparatus as claimed in claim 6, in which said biasing means comprises means electrically connecting said first electrode to said second electrode, and means applying a DC voltage between said cathode and said first and second electrodes.

8. Apparatus as claimed in claim 1, in which said biasing means comprises means applying a first DC voltage between said first electrode and the end of said cathode opposite said first electrode, and means applying a second DC voltage between said second electrode and the end of said cathode opposite said second electrode.

9. Apparatus as claimed in claim 8, wherein said first and second DC voltages are of equal magnitude.

10. Apparatus as claimed in any one of claims 1 through 9, wherein said cathode comprises a wire filament.

11. Apparatus as claimed in any one of claims 1 through 9, wherein said cathode comprises a plasma.

12. Apparatus as claimed in any one of claims 1 through 9, including means for applying a magnetic field extending substantially parallel to said cathode about and within said housing.

13. In apparatus for forming a beam of particles which includes a plurality of ions of a desired material, comprising a generally cylindrical anode, an elongated cathode disposed axially within said anode and extending through apertures formed in first and second end walls of said cathode, means electrically isolating said cathode from said anode, means for introducing a gaseous material which includes the desired material between the cathode and the anode, means for establishing between the anode and the cathode an electric discharge of sufficient intensity to dissociate said gaseous material into a plasma which comprises various particles including a plurality of ions of the desired material, and means for applying a magnetic field to said plasma; the improvement comprising a first electrode received within said first aperture in surrounding relation to said cathode, means electrically isolating said first electrode from said cathode and from said anode, a second electrode received within said second aperture in surrounding relation to said cathode, means electrically isolating said second electrode from said cathode and from said anode, and biasing means operable to apply potentials to said first and second electrodes.

14. Apparatus as claimed in claim 13, in which said biasing means comprises means maintaining said first and second electrodes at equal potentials.

15. Apparatus as claimed in claim 14, in which said biasing means includes means interconnecting said first and second electrodes.

16. Apparatus as claimed in claim 13, in which said biasing means comprises means biasing said first electrode at the potential of said cathode adjacent said second electrode, and means biasing said second electrode at the potential of said cathode adjacent said first electrode.

17. Apparatus as claimed in claim 16, in which said biasing means comprises means electrically connecting said first electrode to said cathode at a point adjacent said second electrode, and means electrically connecting said second electrode to said cathode at a point adjacent said first electrode.

18. Apparatus as claimed in claim 13, in which said biasing means comprises means applying a predetermined potential between said cathode and both said first and second electrodes.

19. Apparatus as claimed in claim 18, in which said biasing means comprises means electrically connecting said first electrode to said second electrode, and means applying a DC voltage between said cathode and said first and second electrodes.

20. Apparatus as claimed in claim 13, in which said biasing means comprises means applying a first DC voltage between said first electrode and the end of said cathode opposite said first electrode, and means applying a second DC voltage between said second electrode and the end of said cathode opposite said second electrode.

21. Apparatus as claimed in claim 20, wherein said first and second DC voltages are of equal magnitude.

22. Apparatus as claimed in any one of claims 13 through 21, wherein said cathode comprises a wire filament.

23. Apparatus as claimed in any one of claims 13 through 21, wherein said cathode comprises a plasma.

24. Apparatus as claimed in any one of claims 13 through 21, wherein said first and second electrodes are cylindrical, said means electrically isolating said first and second electrodes from said cathode comprise first cylindrical insulators disposed radially between said first and second electrodes and said cathode, and said means electrically isolating said first and second electrodes from said anode comprise second cylindrical insulators disposed radially between said first and second electrodes and the end walls of said anode.

* * * * *